US009737822B2

(12) United States Patent
Kubo

(10) Patent No.: US 9,737,822 B2
(45) Date of Patent: Aug. 22, 2017

(54) SPIN SPEED MEASURING DEVICE FOR SPINNING TOY DEVICE

(71) Applicant: TOP RUNNER Co., Ltd., Kokobunji, Tokyo (JP)

(72) Inventor: Masakiyo Kubo, Kokubunji (JP)

(73) Assignee: TOP RUNNER CO., LTD., Kokubunji, Tokyo (JP)

( * ) Notice: Subject to any disclaimer, the term of this patent is extended or adjusted under 35 U.S.C. 154(b) by 0 days.

(21) Appl. No.: 15/133,643

(22) Filed: Apr. 20, 2016

(65) Prior Publication Data

US 2016/0310854 A1 Oct. 27, 2016

(30) Foreign Application Priority Data

Apr. 27, 2015 (JP) ..... 2015-090455

(51) Int. Cl.
*A63H 1/00* (2006.01)
*A63H 1/04* (2006.01)

(52) U.S. Cl.
CPC ..... *A63H 1/04* (2013.01)

(58) Field of Classification Search
CPC ..... A63H 1/00; A63H 1/30
See application file for complete search history.

(56) References Cited

U.S. PATENT DOCUMENTS 2,846,769 A * 8/1958 Colont ..... G01B 3/20 33/710
5,356,328 A * 10/1994 Ho ..... A63H 1/30 446/242
5,791,966 A * 8/1998 Capps ..... A63H 1/24 362/249.16
6,083,076 A * 7/2000 Saint-Victor ..... A63H 1/06 446/236
6,287,193 B1 * 9/2001 Rehkemper ..... A63H 1/30 273/142 H
6,634,922 B1 * 10/2003 Driscoll ..... A63H 1/30 273/142 R
6,743,070 B1 * 6/2004 Lin ..... A63H 1/02 446/15
6,932,324 B2 * 8/2005 Biller ..... B60R 22/1952 254/230

(Continued)

FOREIGN PATENT DOCUMENTS

JP 2007-024793 2/2007

*Primary Examiner* — Aarti B Berdichevsky
*Assistant Examiner* — Urszula M Cegielnik
(74) *Attorney, Agent, or Firm* — Shlesinger, Arkwright & Garvey LLP

(57) ABSTRACT

A spin speed measuring device almost free of malfunction is provided at low cost. The spin speed measuring device includes a casing, a spinning body pivotally supported in the casing, a pinion gear configured to spin together with the spinning body, a belt having a rack and a plurality of indicators, the rack being configured to mesh with the pinion gear, and a detector attached to the casing to detect the indicator passing by. The spin speed measuring device measures the spin speed of the spinning body. A spin speed of the spinning body is calculated from a time period from when one of the indicators passes by to when another one of the indicators passes by, the time period being obtained using signals output from the detector.

6 Claims, 3 Drawing Sheets

(56) References Cited

U.S. PATENT DOCUMENTS

| | | | | |
|---|---|---|---|---|
| 7,252,618 | B2 * | 8/2007 | Spakowski | F02M 26/54 475/343 |
| 7,427,225 | B2 * | 9/2008 | Matsukawa | A63H 1/04 446/256 |
| 7,448,934 | B2 * | 11/2008 | Van Dan Elzen | A63H 1/30 446/236 |
| 8,715,032 | B2 * | 5/2014 | Horikoshi | A63H 1/12 446/256 |
| 9,180,379 | B2 * | 11/2015 | Choi | A63H 1/04 |
| 2003/0064660 | A1 * | 4/2003 | Matsukawa | A63F 3/00895 446/256 |
| 2003/0077977 | A1 * | 4/2003 | Polare | A63H 1/04 446/256 |
| 2003/0199222 | A1 * | 10/2003 | Matsukawa | A63H 30/04 446/256 |
| 2005/0040598 | A1 * | 2/2005 | Wilk | A63F 3/00697 273/288 |
| 2005/0277360 | A1 * | 12/2005 | Benedek | A63H 1/00 446/236 |
| 2009/0253343 | A1 * | 10/2009 | Kitamura | A63F 9/16 446/256 |
| 2012/0088433 | A1 * | 4/2012 | Choe | A63H 1/02 446/256 |
| 2013/0324004 | A1 * | 12/2013 | Schwartz | A63H 30/04 446/259 |
| 2016/0328426 | A1 * | 11/2016 | Muraki | G06F 17/30312 |

* cited by examiner

SPIN SPEED MEASURING DEVICE FOR SPINNING TOY DEVICE

BACKGROUND OF THE INVENTION

Field of the Invention

The present invention relates to a device for measuring the spin speed of a spinning body when spinning the spinning body using a belt and a pinion gear.

Description of Related Art

Conventionally, to measure the spin speed of a toy that is played by spinning, such as a spinning toy, a mark provided on a side of a driving drum that gives a drive to a spinning toy in a spinning manner or on a side of a spinning toy itself is read by a photo sensor to calculate the number of spin per unit time with a processing device including a timing unit. This type of device for measuring a spin speed is typically known as an encoder which adapts a technique described in JP 2007-24793 A.

However, use of a spin speed measuring device using a photo sensor and a processing device disadvantageously raises the production cost of a toy and likely to cause malfunction when assembled in a toy which is handled in a rough manner.

Meanwhile, a spinning toy device has become popular which is configured to spin a spinning toy mounted on a launcher having a driving drum by spinning the driving drum with a belt called a "winder" to let the spinning toy collide against another spinning toy within an area to compete with each other. The toy has a pinion gear coaxially connected to the driving drum and is configured to spin the driving drum by manually pulling the belt meshing with the pinion gear by a rack provided on a face of the belt.

A feature of this mechanism is that the teeth pitch of the pinion gear and the teeth pitch of the rack are the same throughout their entire lengths.

The object of the present invention is to provide without using a photo sensor a spin speed measuring device for a spinning body at low cost and with very small possibility of malfunction.

SUMMARY OF THE INVENTION

In order to achieve the above object, a typical configuration of the present invention includes a casing, a spinning body pivotally supported in the casing to spin the spinning toy, a pinion gear configured to spin together with the spinning body, a belt having a rack and a plurality of indicators, the rack being configured to mesh with the pinion gear, and a detector attached to the casing to detect the indicator passing by, wherein a spin speed of the spinning body is calculated from a time period from when one of the indicators passes by to when another one of the indicators passes by, the time period being obtained using signals output from the detector.

According to the invention, a device that can easily measure the spin speed of a spinning body without using a photo sensor by measuring a transit time of sections defined between a plurality of indicators provided on a belt.

Further features of the present invention will become apparent from the following description of exemplary embodiments (with reference to the attached drawings).

DESCRIPTION OF THE EMBODIMENTS

An embodiment of the present invention will be described below referring to the attached drawings. The embodiment is used for a spinning toy device.

Figure 1:
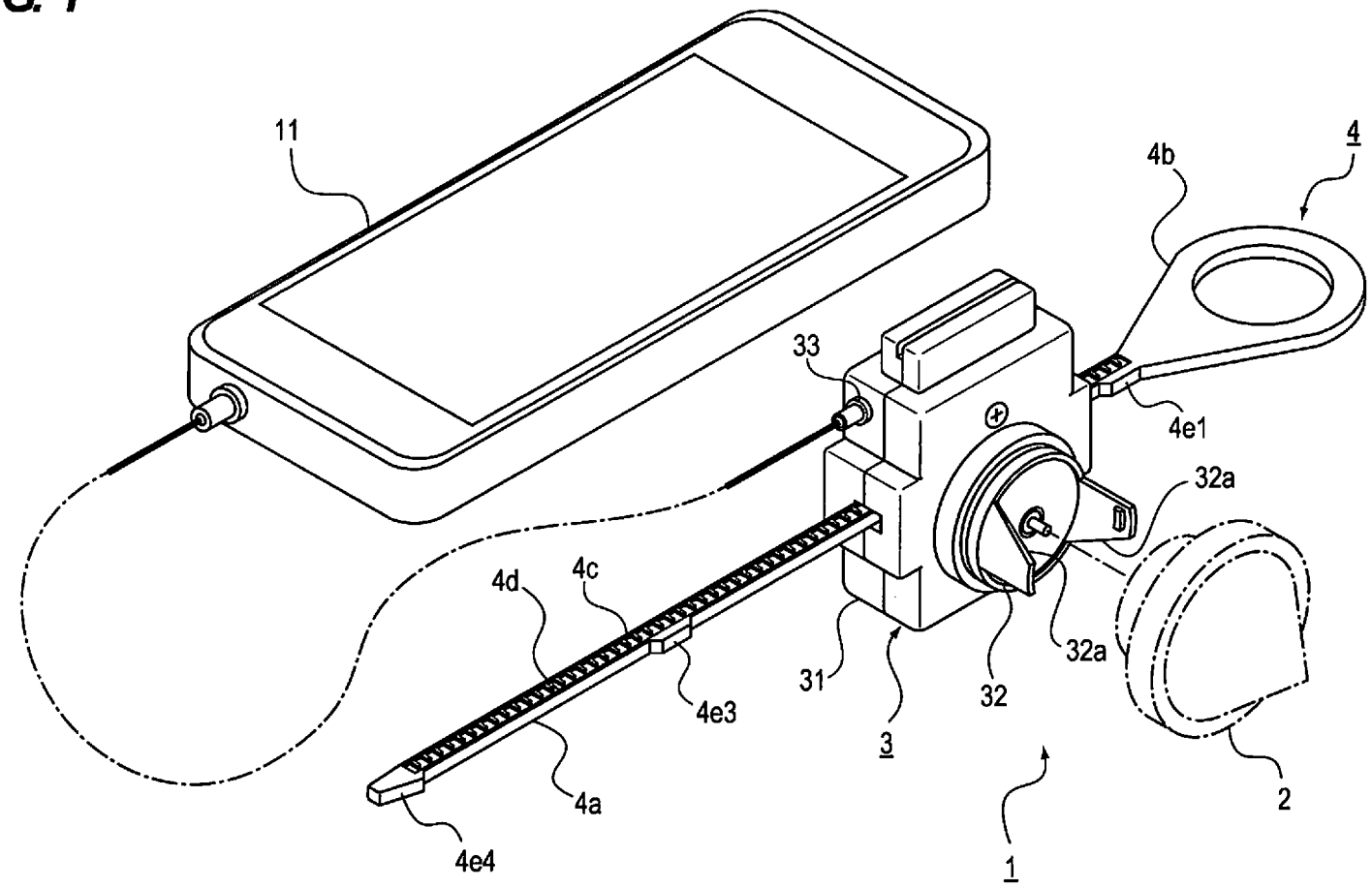
FIG. 1 illustrates a configuration of a set of a spinning toy device according to an embodiment of the present invention.

FIG. 1 illustrates a configuration of a spinning toy device 1 according to the embodiment. A spinning toy 2 is mounted on a spinning holder 32 exposed outside a casing 31 of a launcher 3. The spinning toy device 1 is configured to spin the spinning toy 2 together with the spinning holder 32 by a player pulling a winder (belt) 4 inserted through the launcher 3.

When the winder 4 is pulled out from the launcher 3, a mechanism described below stops the spin of the spinning holder 32 but the spinning toy 2 keeps spinning by its inertia and is pushed outward along a ramp 32*a* of the spinning holder 32 to disengage from the spinning holder 32. In this manner, the spinning toy 2 falls off but keeps spinning.

In the embodiment, a smartphone 11 is used as a data processing and displaying device. An external output terminal 33 is provided on the side of the launcher 3 to connect a cord. The launcher 3 transmits its operational record of the spinning toy 2 conducted by a player to the smartphone 11 via the cord.

Figure 2:
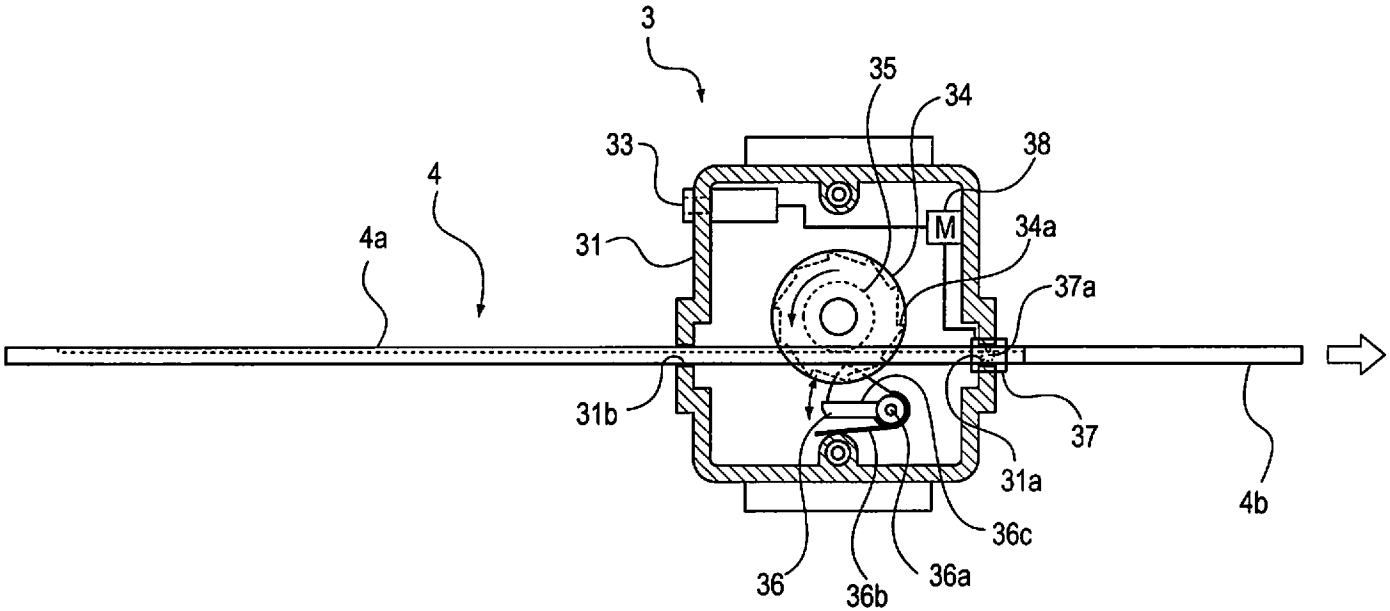
FIG. 2 is a plan view illustrating the internal configuration of a launcher without a top cover according to the embodiment of the present invention.
Figure 3A:
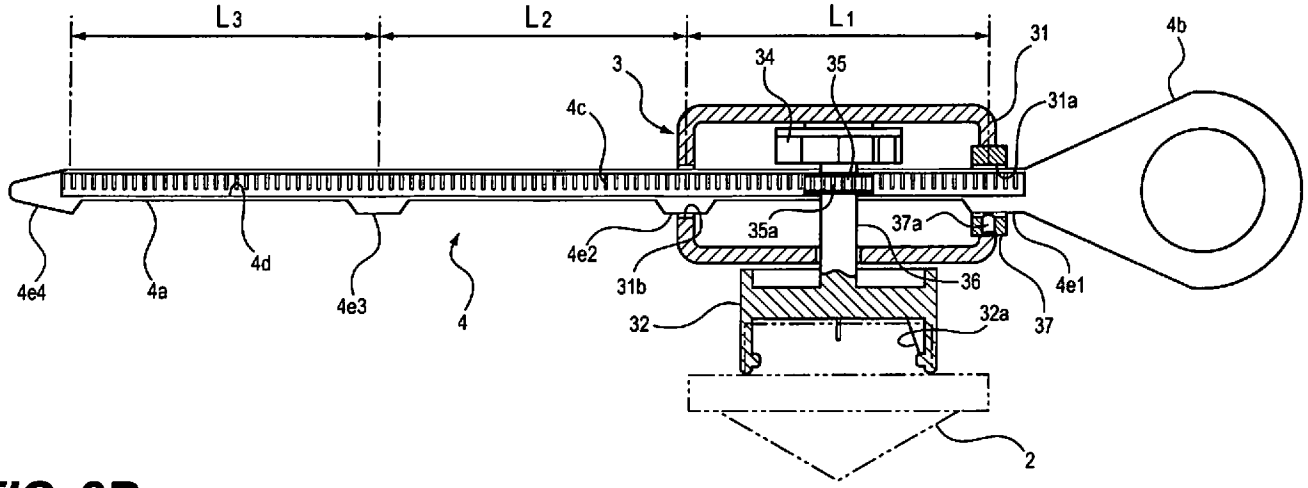
FIGS. 3A and 3B are cross sectional views illustrating the internal configuration of the launcher according to the embodiment of the present invention.
Figure 3B:
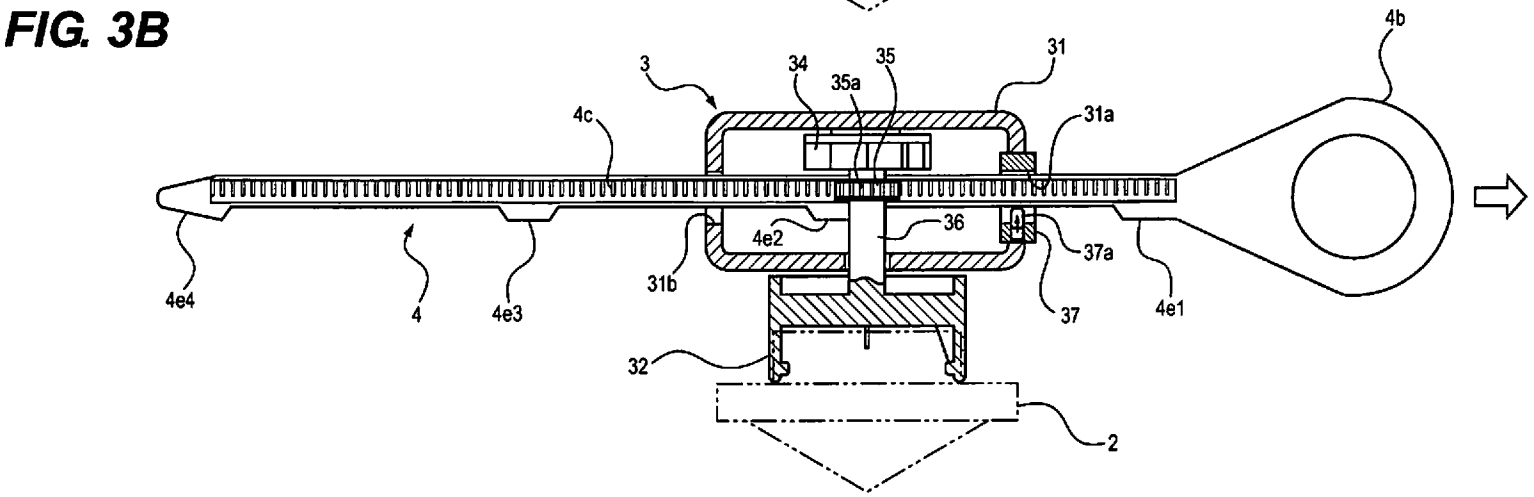

FIG. 2 is a plan view illustrating the internal configuration of the launcher 3 without a top cover according to the embodiment. FIGS. 3A and 3B are cross sectional views of the launcher 3.

A driving drum 34 having steps 34*a* on its side and a pinion gear 35 having evenly spaced pinion teeth 35*a* on its side in a similar manner are coaxially fixed to a rotation axis 31*b* in an integrated manner inside the casing 31 of the launcher 3. The rotation axis 31*b* protruding outside the casing 31 is fixed to a spinning holder 32 to integrally constitute a spinning body.

Openings 31*a* and 31*b* are provided on the right and left sides of the casing 31. The winder 4 runs through the openings 31*a* and 31*b*. A contact switch 37 described below is attached to the opening 31*a*.

A stopper 36 pivotally supported by a pivot shaft 36*a* is provided adjacent the driving drum 34. The stopper 36 has a blade 36*c* pushed against the winder 4 by the force from a coil spring 36*b*. In this manner, a latching mechanism is configured in which, when the winder 4 is pulled out, the blade 36*c* is forced by the coil spring 36*b* to pivot and thereby a portion of the blade 36*c* engages with the step 34*a* provided on the side of the driving drum 34, and thus the driving drum 34 and the spinning holder 32 stop spinning.

The winder 4 is configured with a belt 4*a* and a handle 4*b* provided on an end of the belt 4*a*. The belt 4*a* is flat and has on one of flat faces rack teeth 4*c* disposed at a predetermined pitch. When the winder 4 is inserted through the casing 31, the rack teeth 4*c* mesh with pinion teeth 35*a* of the pinion gear 35. The pinion gear 35 spins by a player pulling out the winder 4 from the casing 31, thereby spinning the spinning toy 2 via the spinning holder 32.

The rack teeth 4*c* are provided within a groove 4*d* of the winder 4. The groove width is substantially the same as the width of the pinion teeth 35*a* of the pinion gear 35, thereby avoiding the belt 4*a* swaying side to side when pulled out.

A plurality of protrusions 4e1 to 4e4 is provided as indicators on a side of the winder 4. Sections L1 to L3 between protrusions 4e1 and 4e2, 4e2 and 4e3, and 4e3 and 4e4, respectively, have the same length. The sections L1 to L3 are also provided with the same number of rack teeth 4c. When the protrusions 4e1 to 4e4 each passes through the opening 31a of the casing 31, the contact switch 37 is activated and thereby the passing of the protrusion is detected.

The contact switch 37 attached to the opening 31a includes a contacting piece 37a. The contact switch 37 is a detector configured to output a signal when the contacting piece 37a is pushed or released from the pushed state. A signal from the contact switch 37 is recorded with time information in a timer equipped memory 38 and output from the external output terminal 33 to an external information processing and displaying device, such as the smartphone 11.

Now the operation of the spinning toy device configured as described above will be described.

As illustrated in FIG. 3A, a player inserts the winder 4 through the launcher 3 to prepare for a game. In this state, the protrusion 4e1 provided close to the handle 4b of the winder 4 is pushing the contacting piece 37a of the contact switch 37.

As illustrated in FIG. 3B, when a player pulls the winder 4, the protrusion 4e1 moves away from the contact switch 37 and the contacting piece 37a rises up. The timer equipped memory 38 starts time counting upon receiving a signal output from the contact switch 37 to measure the time until the next protrusion 4e2 pushes the contacting piece 37a of the contact switch 37.

As the winder 4 moves, the contact switch 37 outputs a signal at a timing when each of the protrusions 4e2 to 4e4 passes by the contact switch 37 and the timer equipped memory 38 records the time when each of the protrusions 4e2 to 4e4 passes by. The timer equipped memory 38 or the external processing device calculates the transit time of each of the sections L1 to L3.

As described above, the ratio of the number of rack teeth 4c between adjacent protrusions among 4e1 to 4e4 to the number of pinion teeth 35a on the entire circumference of the pinion gear 35 is predetermined. Thus the number of spin per minute N (rpm) can simply be calculated by the following equation, where A is the number of rack teeth 4c between adjacent protrusions, B is the number of the pinion teeth 35a on the entire circumference of the pinion gear 35, and t (sec) is a transit time of each of the sections L1 to L3.

$$N\ (\text{rpm})=(A/(B\times t\ (\text{sec})))\times 60 \qquad \text{Equation 1}$$

If a player customizes the spinning toy device 1 by replacing the pinion gear 35 with another part that has a larger or smaller diameter, thus having a different number of pinion teeth, the spin speed is recalculated using a replaced number of B. If the pinion gear 35 is not replaced, the ratio R=A/B calculated by the unchanged numbers A and B can be registered so that the spin speed N can easily be calculated using the following equation.

$$N\ (\text{rpm})=R/t\ (\text{sec})\times 60 \qquad \text{Equation 2}$$

Spin speeds N1 to N3 can be measured for the sections L1 to L3, respectively. So that by differentiating variation of the spin speeds N1 to N3, acceleration can be calculated. Any one or more of the protrusions 4e1 to 4e4 may be used for the calculation. For example, if the times recorded when the first protrusion 4e1 and the fourth protrusion 4e4 have passed by are used, the average spin speed of the entire section can be calculated.

The time data on when the protrusions 4e1 to 4e4 have passed by are first stored in the timer equipped memory 38 and then output to an external processing device, such as the smartphone 11, after the game to display the calculated result of the spin speed N.

According to the spin speed measuring device described above, the spin speed of the spinning body can easily be measured by detecting a plurality of protrusions 4e1 to 4e4 of the winder 4 passing by and measuring the time when each of the protrusions 4e1 to 4e4 passing by. In particular, the embodiment is configured with a simple structure that has indicators provided as the protrusions 4e1 to 4e4 and the detector provided as the contact switch 37, which reduces production cost. In addition, without any complex function, the embodiment is advantageously almost free of malfunction.

Since the rack teeth 4c are provided on a main face of the belt (winder 4) and the protrusions 4e1 to 4e4 are provided on a side face of the belt, the rack teeth 4c and the protrusions 4e1 to 4e4 function independently without interfering with each other. With the rack teeth 4c provided within the groove 4d provided on the belt, the pinion gear 35 meshing with the rack teeth 4c guides both side walls of the groove 4d to prevent the belt swaying side to side in a horizontal direction, so that the protrusion 4e1 to 4e4 can make smooth contact with the contact switch 37.

Four protrusions and three sections are provided in the embodiment, although when at least two protrusions are provided as an indicator, one section can be recognized for measurement. Instead of a protrusion serving as the indicator, a notch or a hole may be provided to activate the contact switch. The protrusions and depressions provided on the belt and the contact switch serve as the indicator and the detector, although this is not the only configuration of an embodiment of the invention. For example, the indicator and the detector may be configured with a magnet and a magnetic sensor.

The pinion gear 35 and the driving drum 34, which is a spinning body, are provided as separate members in the embodiment, although it goes without saying that the pinion gear 35 may be integrated with the spinning body by providing the pinion teeth 35a on the circumferential surface of the driving drum 34. The timer equipped memory 38 may be an external processing device, such as the smartphone 11 always connected to an external output terminal 33. The external processing device may perform calculations, such as those expressed in Equations 1 and 2. Alternatively, together with the timer equipped memory 38, a liquid crystal display may be provided on the external of the casing 31 of the launcher 3 as a display device for displaying a calculated result. Furthermore, by mounting a communication device on the launcher 3, information processing data can be transmitted between the external processing device or the external display device on a real-time basis without wiring connection.

The spinning toy device is not necessarily a toy for spinning a real spinning toy to play a game. The spinning toy device may be used as an input device to obtain data, such as spin speed data, using the spinning toy as a dummy, to be used in a processing device or a virtual space on a network to play a game. The embodiment of the present invention is used for a spinning toy device, although any other embodiment having a mechanism using a rack and a pinion gear can be used. For example, the invention can be used for a propeller toy or an engine starter.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-90455, filed Apr. 27, 2015, which is hereby incorporated by reference herein in its entirety.

I claim:

1. A spin speed measuring device for a launcher to spin a spinning toy, the spin speed measuring device comprising:

a casing;

a spinning body pivotally supported in the casing to spin the spinning toy;

a pinion gear configured to spin together with the spinning body;

a belt having a rack and a plurality of indicators provided with a predetermined distance from each other, the rack being configured to mesh with the pinion gear;

a detector attached to the casing to detect the indicator passing by, and a calculator which has information of the predetermined distance between the indicators and disposed inside or outside the casing wherein the calculator calculates a spin speed of the spinning body from the predetermined distance and a time period from when one of the indicators passes by to when another one of the indicators passes by, the time period being obtained using signals output from the detector and wherein the indicator is a protrusion or a notch provided on the belt, and the detector is a contact switch activated by the protrusion or the notch.

2. The spin speed measuring device according to claim 1, wherein the protrusion or the notch is provided on either one of side faces of the belt, the side faces being faces other than a face provided with the rack.

3. The spin speed measuring device according to claim 1, wherein the spin speed of the spinning body is calculated by an external processing device connected by wire or wirelessly.

4. The spin speed measuring device according to claim 1, wherein calculation of the spin speed of the spinning body is performed by a processing device in an internal memory.

5. The spin speed measuring device according to claim 1, comprising three or more of the indicators and configured to calculate acceleration by differentiating speeds corresponding to a plurality of sections defined between the indicators.

6. The spin speed measuring device according to claim 1, wherein the spinning toy is a dummy for obtaining the spin speed of the spinning body, the spin speed being used as manipulating information to play game in video or on a network.

* * * * *